United States Patent [19]

Conklin, Jr.

[11] 4,383,465

[45] May 17, 1983

[54] SPACE-WRAPPED STRINGS FOR MUSICAL INSTRUMENTS

[75] Inventor: Harold A. Conklin, Jr., Hamilton County, Ohio

[73] Assignee: Baldwin Piano & Organ Company, Cincinnati, Ohio

[21] Appl. No.: 305,483

[22] Filed: Sep. 25, 1981

[51] Int. Cl.[3] ..... G10D 3/10

[52] U.S. Cl. ..... 84/199; 84/197

[58] Field of Search ..... 84/197, 199, 297 S

[56] References Cited

U.S. PATENT DOCUMENTS 3,605,544 9/1971 Kondo ..... 84/199
3,826,171 7/1974 Kaar ..... 84/297 S

FOREIGN PATENT DOCUMENTS 185219 4/1956 Austria ..... 84/297 S
578743 10/1924 France ..... 84/297 S

*Primary Examiner*—Lawrence R. Franklin
*Attorney, Agent, or Firm*—Frost & Jacobs

[57] ABSTRACT

Wrapped strings for musical instruments having a predetermined speaking length, wherein the wrapping wire is wound on the core wire to provide uniformly spaced helical convolutions spaced from each other by a distance at least as great as the diameter of the wrapping wire, the wrapping wire having a diameter smaller than the diameter of the core wire, said wrapped strings being so wrapped only within the speaking lengths of the strings.

10 Claims, 8 Drawing Figures

SPACE-WRAPPED STRINGS FOR MUSICAL INSTRUMENTS

This invention relates to strings for musical instruments, and more particularly to wrapped strings comprising a core wire and a helically wound wrapping wire.

BACKGROUND OF THE INVENTION

Early stringed instrument builders discovered that by adding a helical wrapping around the core wire of strings in the bass portion of the scale of the instrument it was possible to increase the level of the sound output and improve the quality of the tone obtained. The function of the wrapping was to cause the tension or pull of the string for a given frequency of vibration to become larger than it would be without a wrapping. It was a characteristic of these antique strings that the wrappings were wide-spaced and extended the full length of the core wire, hence passing over the bridge and around the tuning pins. Insofar as known, the wrapping of such strings was empirical and without defined parameters.

Modern instruments abandoned the use of wide-spaced turns of wrapping and adjacent turns, i.e., contacting or near-contacting turns, have become the norm. In contemporary practice the wrapping extends only over the greater part of the speaking length of the strings, ending just before it reaches either the agraffe or the bridge.

In modern instruments the effect of the wrapping is controlled by the size and weight of the wrapping wire in relation to the core wire used. Until recently, the size of the wrapping wire was normally calculated in terms of the size necessary to produce for a given frequency a particular value of tension or pull on the string. U.S. Pat. No. 3,523,480 taught that another significant factor in the design of wrapped strings is the tuning of the longitudinal mode of vibration of the string. It was found that the tone quality of the instrument could be significantly improved by careful design of the string so that the frequency of the longitudinal mode of vibration would be tuned to a particular value in relation to the transverse or flexural mode of vibration of the string.

In order to control the frequency of the longitudinal mode of the string vibration, careful control of the wrapping wire size and weight is necessary. The minimum diameter of wrapping wire which is practical to use in a piano is on the order of about 0.01" (0.25 mm) if the material of the wrapping wire is copper. If the wrapping material is copper-covered steel wire the smallest practical size is about 0.006" (0.15 mm). For wrapping material appreciably smaller in diameter than these values it becomes increasingly difficult to wrap the string because of the tendency for the wrapping wire to break. In addition, the tonal quality of the string may be impaired by lack of liveness if very small diameter wrapping wire is used.

It is often desirable in the design of a wrapped string to achieve less loading of the core wire than can be achieved by using even the smallest practical size of wrapping wire. The present invention provides the solution to this problem and makes it possible to reduce the amount of loading on the string in a controlled and reproducible way by varying the spacing between the turns rather than by changing the size of the wrapping wire. It may be noted that U.S. Pat. No. 3,605,544 teaches the provision of wrapped strings wherein the turns of the wrapping wire do not make contact with each other. Specifically, the patent teaches that the space between adjacent turns of the wrapping wire is preferably made as small as possible so long as the adjacent turns do not touch each other in vibration, the spacing being from 0.1–0.3 mm. The stated purpose of the invention is to eliminate noises and loss of energy, both of which are stated to be caused by the frictional contact between adjacent convolutions of the wrapping wire. The patent does not address itself to the problem of providing tuned strings by controlling the spacing of the wrapping wire, or of controlling inharmonicity and string tension. In particular, the present invention solves the problem of providing wound strings for a piano in scale ranges where even the lightest practical conventional wraps are still too heavy for the purpose.

SUMMARY OF THE INVENTION

The present invention may be utilized to improve the design and performance of pianos in several different ways. For example, it has been found desirable to use lightly loaded wrapped strings at certain locations in a piano scale in order to reduce inharmonicity. Excessive inharmonicity is inherent in the spectral components of notes which employ plain wire strings that are too short or have a diameter too large in relation to their length. In many existing pianos the evenness of the scale and the quality of tone could be improved by utilizing lightly loaded wrapped strings within at least a portion of that region of the scale extending downward from approximately middle "C" (note 40 on the standard piano keyboard) approximately two octaves to the "C" which is note 16 on the standard keyboard. It is a standard practice that plain wire strings are used in the upper part of this region and that conventional close-spaced wrapped strings are employed in the lower part. Inharmonicity increases rapidly as the speaking length of the strings is decreased. The speaking length of the strings of most notes within this scale region must necessarily decrease with the size and length of the piano because the length of the case decreases progressively from a concert grand piano down to the smallest spinet. In order to compensate for the decrease of string speaking length and the resulting reduction of string pull, it is a standard practice to employ plain wire strings of larger and larger diameter, not only as the piano size decreases, but also, within a particular scale, as the notes progress toward the bass.

The combined effect of reduced string length and increased string diameter leads to increased inharmonicity with accompanying poor tone quality. This condition worsens with descending scale notes down to the last note having plain wire. In most scales it would be desirable to extend the wrapped string portion of the scale up into this region, but it is literally impossible to design conventional close-spaced wrapped strings which perform well in this part of the scale because impractically small wrapping wire would be required and because, even if it were practical to use very small wrapping wire, the large number of turns of very fine wire that would be needed would give a string lacking in liveness or life in its tone. Because of these difficulties, plain wire strings usually extend much farther downward in the scale than is consistent with good results. The outcome is not only that the lowest several notes using plain wire have excessive inharmonicity and a bad sound, but also that there is a pronounced scale "break", i.e. an abrupt change in the quality of the tone, between the last plain wire note and the first wrapped-string note. These defects may be corrected by the use of space-wrapped strings designed to prevent excessive inharmonicity of the lower scale notes in the transitional region, and also to provide a smooth transition in the value of inharmonicity from note to note, so as to eliminate the scale "break" described above.

It is also desirable to provide for a smooth transition in the tension or pull of the strings, and in the mass of the strings from note to note, these goals generally being considered desirable in all scales. Abrupt changes in tension or pull and in the mass of individual strings can be responsible for undesirable changes in tone quality and such changes often occur in the same transitional region from plain wire to wrapped strings that has just been described in connection with inharmonicity. When conventional close-spaced wrapped strings are used at this transitional point, the jump in tension and mass of the individual strings is so large that it usually is necessary, in order to obtain a reasonably uniform progression of total string mass from note to note, to shift from using three strings per note on the plain wire strings to two strings per note on the wrapped-string notes. Such a shift may produce an undesirable scale break. The present invention makes it practical to retain the same number of strings per note on either side of this scale transition point; that is, three space-wrapped strings per note may be adjacent to three plain wire strings without an undesirable increase in the mass or pull of the individual strings. The change from three strings per note to two strings per note thus may be made entirely within the wrapped string section of the instrument, thus tending to minimize changes in tone.

Still another beneficial application of strings made according to the present invention has to do with pianos having scales designed to have the longitudinal mode of string vibration "tuned" according to the teachings of U.S. Pat. No. 3,523,480. Accurate tuning of the longitudinal mode can be achieved by controlling the spacing between adjacent turns with the core and the wrapping wire sizes remaining the same. The present invention not only makes it possible to longitudinally tune certain strings more accurately than before, but also makes it possible to longitudinally tune the strings in certain sections of the scale where tuning was heretofore either impossible or impractical. In connection with improved longitudinal mode tuning accuracy it should be explained that, according to U.S. Pat. No. 3,523,480, tuning of the longitudinal mode of string vibration can be achieved in a piano by selecting exactly the speaking length of the plain strings or, in the case of the wrapped strings, by selecting both the speaking length of the string and the relative mass of the wrapping of each string in relation to its core wire.

Two improvements in longitudinal mode tuning are provided by the present invention. One is that it is now possible to tune longitudinally the strings in regions where the strings may be too long to be tuned by using conventional close-spaced wrapping, but too short to have the correct longitudinal frequency if no wrapping is used. Space wrapping makes it possible to tune the strings longitudinally in such scales, because very small amounts of loading can be achieved. The other new benefit of space-wrapped strings in connection with longitudinal mode tuning is that for the first time the scale designer can tune the longitudinal frequency of a string of predetermined length continuously instead of in discrete steps. Previously, tuning in discrete steps was necessary because in order to increase or decrease the loading of a string it was necessary either to change to the next larger or to the next smaller size of wrapping wire. While it is in theory possible to manufacture covering wire in special sizes, it would be impractical and excessively expensive to have available every useful wire size. Thus, in cases where the speaking length of the strings cannot be varied, a compromise between the optimum size of covering wire and the nearest available standard wire size is sometimes necessary. The present invention eliminates such compromises because it provides an additional parameter (the spacing between the turns of wrap), which can be varied continuously, thus making possible more accurate longitudinal mode tuning of the strings.

In accordance with the invention it has been found that, over a certain range of wrapping wire feed angles, the number of turns of wrapping wire on a string varies in a repeatable and predictable fashion as a function of the wrapping wire feed angle, and that over another portion of the range of usable feed angles the number of turns on successively wound strings having identical wrapping specifications tends to vary widely even though the feed angle is held constant. It also has been found that there is a feed angle which will be termed the critical angle which figures in the determination of the stable versus the unstable range, and that this critical angle has a value determined trigonometrically by the geometry and relative ratio of the diameters of the wrapping wire and the core wire.

DESCRIPTION OF THE DRAWINGS

FIG. 6 is a graph plotting the information of FIG. 4 in different form.

DESCRIPTION OF THE PREFERRED EMBODIMENT

Figure 1:
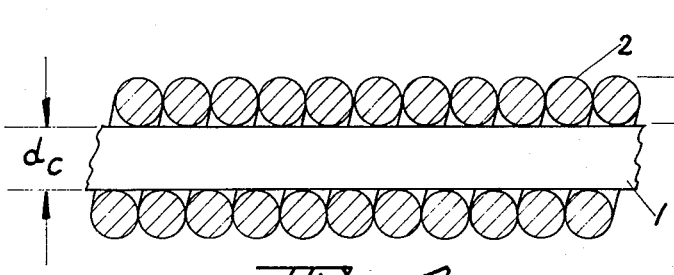
FIG 1 PRIOR ART
FIG. 1 is a cross section of a segment of a conventional wrapped piano string.
Figure 2:
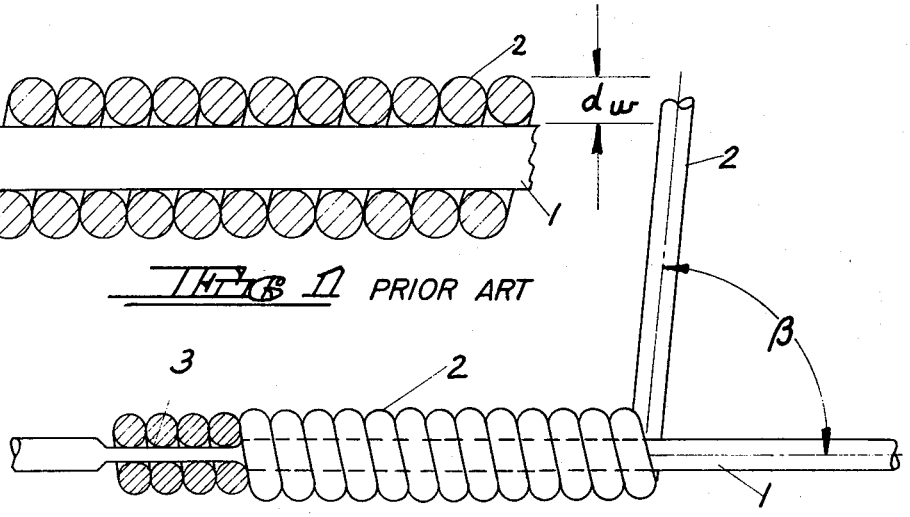
FIG 2 PRIOR ART
FIG. 2 is a diagrammatic illustration of the piano string of FIG. 1 during the wrapping operation.

Referring first to FIG. 1 of the drawings, it illustrates a segment of a conventional wrapped piano string having a core wire 1 and a wrapping wire 2, both of which are circular in cross-section, the core wire having a diameter designated as $d_c$ and the wrapping wire having a diameter designed as $d_w$. FIG. 2 illustrates the same string in the process of being wrapped on a winding machine, such as that described in U.S. Pat. No. 4,055,038. Before the string is wrapped, the core wire 1 is stretched by the machine to a pre-set tension, and the core wire is flattened, as indicated by the flattened area 3 near each end of the string where the wrapping will begin and end, the flattening of the core wire being done in order to provide an anchor means for the ends of the wrapping so as to prevent it from coming loose. The wrapping wire is then applied and fixed to the flattened part at one end of the core wire and the core wire is rotated at a pre-set speed. The flattened areas 3 lie in close proximity to the ends of the speaking length of the string. The speaking length of the string is the distance between two fixed points along the string which determine the vibrational limits of the string. Vibration of the string occurs primarily between these two points and not beyond them. In a piano, one of these points will be a metal agraffe or other terminating fixture of a known type, and the other point will be at the bridge of the instrument, where the string crosses the bridge and comes into contact with a metal bridgepin. In contemporary pianos which use close spaced wrapped strings, the wrapping normally covers almost but not quite all of the speaking length of the string; that is, the wrapping ends just before it reaches either the agraffe or the bridgepin, normally leaving approximately one-quarter inch to one inch of the core wire uncovered. This is done to prevent improper vibration of the string, or damage to the wrapping through contact with the fixed terminating points.

Whereas in the operation of earlier types of winding machines the angle of approach of the wrapping wire to the core wire was left to be determined by the machine operator who was hand-feeding the wrapping wire onto the core wire, the machine of U.S. Pat. No. 4,055,038 is capable of feeding the wrapping wire onto the core wire at a constant but adjustable approach or feed angle. This feed angle is defined as the angle measured between the axis of the core wire 1 and the axis of the wrapping wire 2 and is designated in FIG. 2 as the angle $\beta$.

As those familiar with the practical aspects of winding piano strings will understand, the value of the feed angle $\beta$ can have a dramatic effect of the progress of the winding. In winding strings having conventional close-spaced turns the angle $\beta$ is normally held to a value just slightly less than 90 degrees. If the angle is increased to beyond 90 degrees the wrapping will suddenly turn back upon itself, and will progress from right to left in FIG. 2, insteaad of from left to right as desired. If the value of the angle $\beta$ is decreased much below 90 degrees the turns of the string will no longer be close-spaced or contacting but will spread out along the string so that the winding, if closely inspected, will be seen to have spaced-apart turns. The spacing between the turns will generally appear erratic and uneven. This is undesirable in a finished piano string because the resulting loading of the wrapping will be nonuniform and the characteristics of the string will not be exactly predictable unless the number of turns and the spacing between the turns can be controlled accurately.

Figure 3:
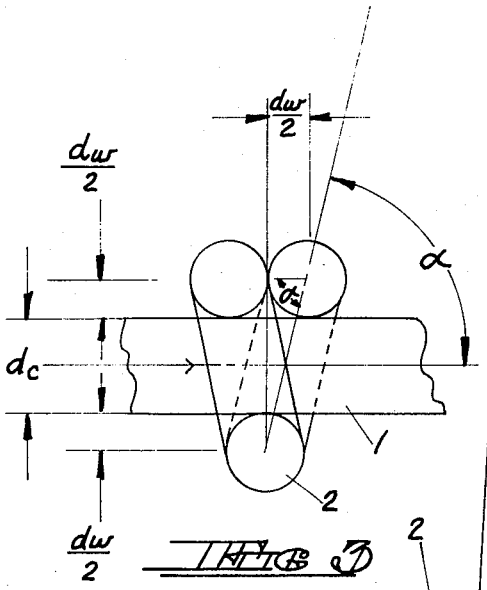
FIG. 3 is an enlarged diagrammatic illustration of a short segment of a wrapped string.

It has been discovered that the reproducibility of a wrapped string depends importantly upon the relation between the feed angle $\beta$ in actual use to wind the string and a critical angle which will be termed angle $\alpha$. The critical angle $\alpha$ is the helix angle formed by the axes of the core wire and adjacent contiguous turns of wrapping wire, as will be understood by reference to FIG. 3 which shows in cross section a very short segment of a wrapped string. As will be apparent from FIG. 3, the value of the critical angle $\alpha$ will depend upon the relative diameters of the core wire ($d_c$) and the wrapping wire ($d_w$) as expressed by the formula:

$$\alpha = \mathrm{TAN}^{-1}\frac{2(d_c + d_w)}{d_w} \quad (1)$$

Utilizing this formula, the values of the helix angle can be readily computed for strings made with various commonly used wrapping wire diameters wound upon a core wire of a selected diameter. In the case of core wire having a diameter of 0.043", the computed values are as follows:

TABLE I

| Core Wire Diameter in inches | Wrap Wire Diameter in inches | Angle $\alpha$ in degrees |
|---|---|---|
| .043 | .0118 | 83.9 |
| .043 | .0128 | 83.5 |
| .043 | .0132 | 83.3 |
| .043 | .0140 | 83.0 |
| .043 | .0150 | 82.6 |
| .043 | .0162 | 82.2 |
| .043 | .0173 | 81.8 |
| .043 | .0181 | 81.6 |
| .043 | .0204 | 80.9 |
| .043 | .0230 | 80.1 |
| .043 | .0258 | 79.4 |
| .043 | .0286 | 78.7 |
| .043 | .0301 | 78.4 |
| .043 | .0317 | 78.0 |
| .043 | .0332 | 77.7 |
| .043 | .0348 | 77.4 |
| .043 | .0379 | 76.8 |
| .043 | .0410 | 76.3 |
| .043 | .0443 | 75.8 |

As can be seen from Table I, the value of the critical angle varies from 83.9 degrees for a wrapping wire 0.0118" in diameter to 75.8 degrees for a wrapping wire 0.0443" in diameter.

Figure 4A:
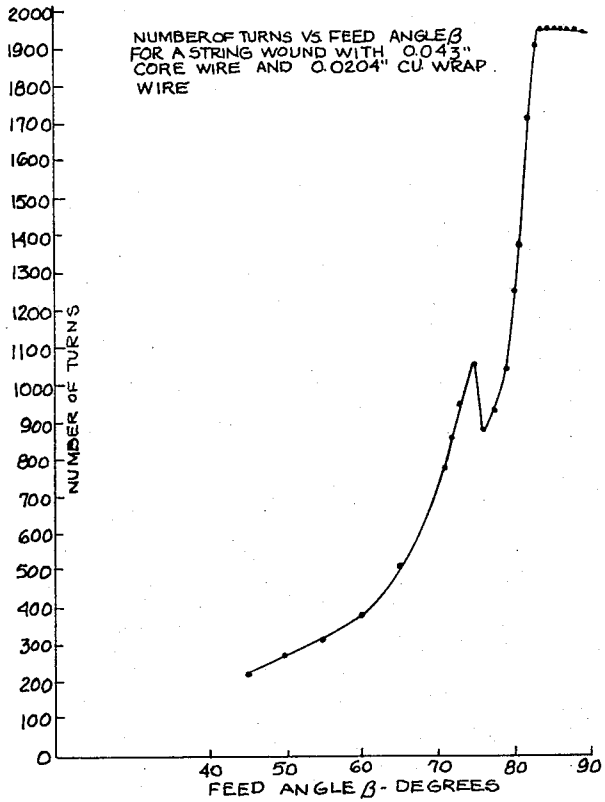
FIG. 4 is a graph plotting the number of turns of wrapping wire as a function of its feed angle.

Utilizing the winding machine of U.S. Pat. No. 4,055,038, numerous measurements were made of the character of the wrapping wire and the number of turns of wrapping wire applied to a fixed length of core wire as a function of the feed angle $\beta$. Representative results are shown by the graph of FIG. 4 which plots the number of turns of 0.0204" diameter wrapping wire applied to a core wire of 0.043" diameter as the feed angle $\beta$ was varied over a range from 90 degrees to 45 degrees. The length of the wrapped portion of the core wire was in all cases 40".

By reference to the graph of FIG. 4 the following characteristics can be observed. First, if the length of the wrapped portion of the string is divided by the diameter of the wrapping the result is $40/0.0204 = 1960.8$ turns. This is the maximum number theoretically possible, assuming that the diameter of the wrapping wire is accurately known and that negligible change of the wrap diameter takes place during the wrapping process. By reference to the curve it will be seen that for feed angles between 90 degrees and 84 degrees the number of turns on the string remained essentially constant with a very slight increase in the number of turns between 90 degrees and 85 degrees, where it peaked at 1954 turns, just 6 to 7 turns less than the theoretical maximum number.

Then, beginning at a feed angle of about 83 degrees it will be seen that the number of turns begins to decrease very rapidly with decreasing angle. The slope of the curve is so steep in this region that a reduction in the angle $\beta$ of only about 5 degrees gives a reduction of the number of turns on the string to approximately one-half the maximum number possible. A reduction to one-half the maximum possible number of turns implies a space between adjacent turns equal in width to the diameter of the wrapping wire. Not only does the number of turns of the string decrease rapidly with decreasing feed angle, but the repeatability or ability to wind successive strings which will have the same number of turns also diminishes rapidly, as does the uniformity of spacing between the turns. These phenomena occur when the feed angle $\beta$ is in the vicinity of the critical angle, which, as Table I shows, has a calculated value of 80.9 degrees for strings made with 0.0204" wrapping wire on a core wire 0.043" in diameter. At and around the critical angle a region of instability exists where both the number of turns of a string and the spacing of the turns along the length of the string vary widely. Therefore, if the objective is to manufacture strings having reproducible characteristics, it is desirable to avoid designs having a winding pitch which falls within this unstable region.

As the feed angle is decreased further, the stability of the winding process improves, and it becomes possible to wind successive strings having essentially identical characteristics. However, such repeatable characteristics will not be obtained when the spacing between adjacent turns is less than the diameter of the wrapping wire, or when the feed angle is in the vicinity of the critical angle as herein defined.

In general the behavior of other combinations of core and wrapping wire will be similar to that just described, although each combination will follow a different curve. It also should be pointed out that differences in the properties of the wire used, such as the relative hardness and tensile strength of copper covering wire, and differences in the winding parameters, such as the tension on the wrapping and core wires, etc., can change the results to some degree.

To explain the results just described it is necessary to consider the forces acting on the string as it is being wrapped. It should be understood from FIG. 2 that there is a force exerted by the winding machine which is pulling in an upward direction (away from the core wire) along the axis of the wrapping wire 2. Since this force always acts axially along the wrapping wire it is evident that its direction will change if the feed angle $\beta$ is changed. When the feed angle is 90 degrees the only component of this force tends to pull the core wire upward in a direction normal to the axis of the core wire. However, in the construction of the winding machine, a feed arm is provided which has at its bottom end a "foot" which bears against the stretched core wire and prevents the upward force of the wrapping wire from deflecting the core wire significantly away from its stretched straight-line condition. But as the feed angle is decreased from 90 degrees, the axial force along the wrapping wire may be resolved into two components: (a) an upward force still normal to the core wire, and (b) a force tending to pull apart the turns of wrapping wire in a direction axially along the core wire. Forces (a) and (b) act on the wrapping wire in the vicinity of the point at which it contacts the core wire.

Figure 5:
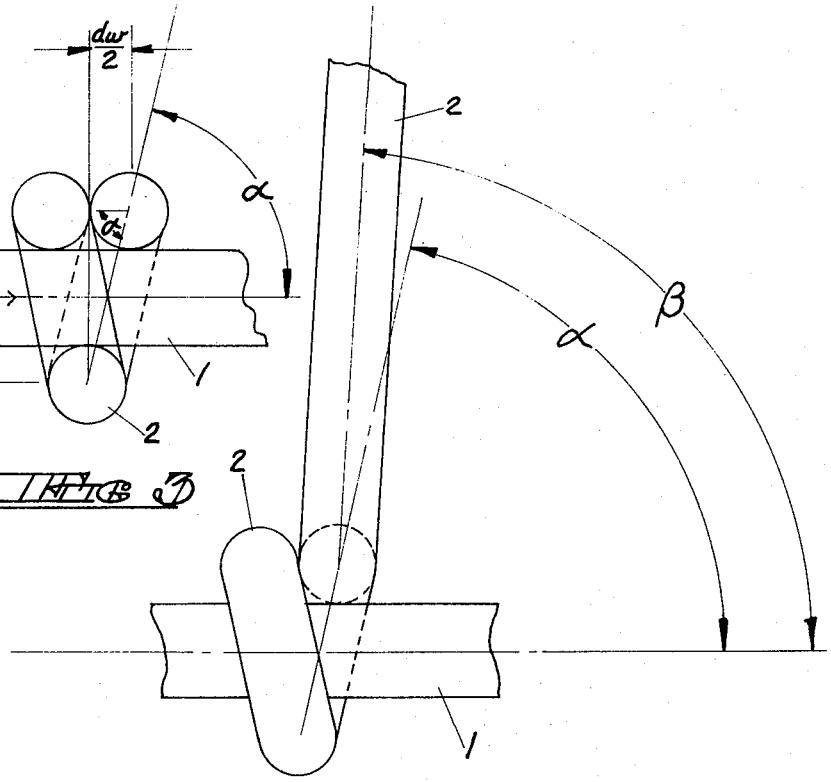
FIG. 5 is an enlarged diagrammatic illustration similar to FIG. 3 of a short segment of a wrapped string.
Figure 3B:
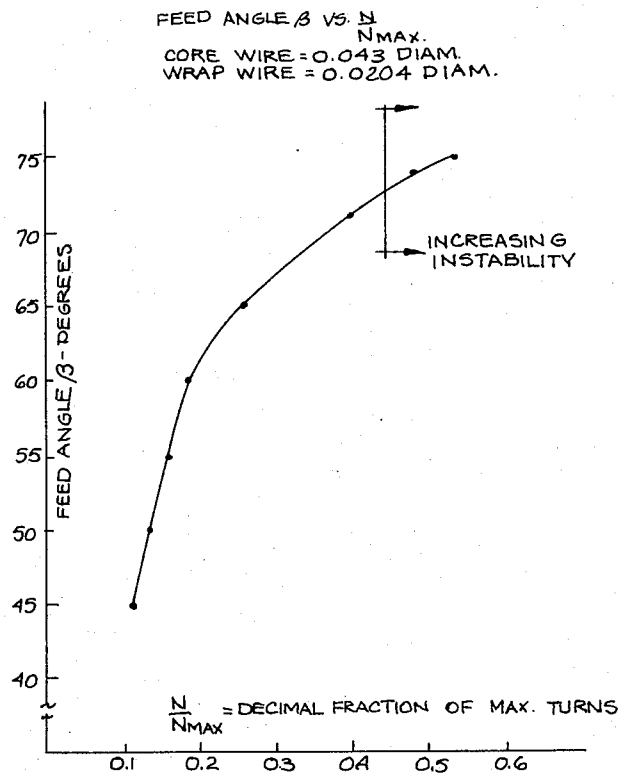

A third force (c), acting locally at the junction of the wrapping wire with the core wire, also affects significantly the winding process. This force relates to the helix angle of the wrapping in the case of a string being wound with contiguous turns. The drawing of FIG. 5 is similar to FIG. 3 except that it illustrates the geometry at this junction and shows that as long as the feed angle $\beta$ is greater than the helix angle $\alpha$ the wrapping wire is forced against the preceding turn of wrap and thus the turns cannot spread apart significantly. As the feed angle approaches the critical helix angle $\alpha$, the force tending to compact the turns of wrap becomes less and less until finally it becomes zero, theoretically at the exact value of the helix angle, but practically, because all the parts are in motion and because various small perturbing forces exist due to the rotation of the core wire and to the surface roughness and friction which exist between the core wire and the wrapping wire, the angle at which the compacting force becomes zero may only be stated to lie close to the theoretical value. Once the compacting force nears zero it will be understood that any small perturbing force in one direction or the other will persuade the turns of the wrapping to alternately spread farther apart or to become closer together in a relatively uncontrolled manner. This explains the instability of strings wrapped in this range. As the feed angle is decreased, the component of the wrapping wire axial force tending to pull apart the turns becomes large in relation to the perturbing forces, and the wrapping becomes more stable.

In order to make the information of the graph of FIG. 4 readily usable in the design of space-wrapped strings, it is desirable to re-plot the same information in a different form. This has been done in FIG. 6, which tells the string designer at what feed angle to wind the string in order to produce a winding having a given fraction $N/N_{max}$ of the maximum possible number of turns. The designer must know what percentage or fraction of the maximum loading he requires in order to use this chart. Once knowing the desired loading, the chart will give the correct winding feed angle. This graph applies only to the particular combination of core and wrap sizes indicated. For other core and wrap sizes the curves will be similar but the values will not be the same.

In designing a string the designer normally uses one or more formulas in order to determine the desired loading. In the case of a wrapped string, a significant factor needed in most formulas is one which gives for the particular core and wrapping wire to be used a number equal to the sum of the mass of the core plus the mass of the wrap, this sum being divided by the mass of the core, in accordance with the formula:

$$\frac{M_c + M_w}{M_c} = F = 1 + \frac{\pi \rho_w}{\rho_c} \frac{(d_w^2 + d_c d_w)}{d_c^2} \qquad (2)$$

wherein $M_w$=mass of wrapping wire
$M_c$=mass of core wire
$F=(M_c+M_w/M_c)$
$\rho_w$=density of wrapping wire
$\rho_c$=density of core wire
$d_w$=diameter of wrapping wire
$d_c$=diameter of core wire
$\pi=3.14159\ldots$ This formula applies to wrapped strings having a single layer of wrapping in which the core wire and the wrapping wire are each assumed to have a circular cross section.

The results of formula (2) have been made conveniently available for use in designing conventional close-spaced wrapped strings by means of computer-derived tables containing the results for commonly used types and sizes of core and wrapping wires. These existing tables can be used along with another formula to determine the needed value of $N/N_{max}$ so that a graph, typically like that of FIG. 6, can then be used to determine the correct winding feed angle. The additional formula is necessary because the tables do not allow for any space between the turns of the wrapping. The derivation of the additional formula now will be explained.

Referring again to formula (2), it will be seen that for a conventional wrapping the loading factor F may be broken into two parts, as shown by the formula:

$$F = \frac{M_c + M_w}{M_c} = \frac{M_c}{M_c} + \frac{M_w}{M_c} = 1 + \frac{M_w}{M_c} \quad (3)$$

For a space-wrapped string the mass added by the wrapping will no longer be $M_w$ but instead will be $M_w \times N/N_{max}$, so the loading factor F' for a space wrapped string will be given by the formula:

$$F' = 1 + \frac{N M_w}{N_{max} M_c} \quad (4)$$

By combining formulas (3) and (4), formula (5) can be obtained. Formula (5) tells how to find the required value of $N/N_{max}$ for a space-wrapped string when the desired loading factor F' is known and when it has been decided what core wire and wrapping wire combination will be used. The factor F will be obtained from existing tables for this combination, as through it were to be used to make a close-spaced wrapped string.

$$\frac{N}{N_{max}} = \frac{F^1 - 1}{F - 1} \quad (5)$$

The string designer will know the desired value of F or F', which will depend upon the properties and performance he is trying to achieve. However, the following example is given to illustrate the manner in which the required value of F or F' is determined.

In order to calculate the effective pull or tension of a plain wire piano string the following formula may be used. This formula or some variation of it will be known to persons familiar with piano scale design practice.

$$\text{PULL} = \frac{f^2 L_s^2 d_c^2}{K} \quad (6)$$

In formula (6), f is the fundamental flexural frequency required of the string, $L_s$ is the speaking length, $d_c$ is the diameter of the string, and K is a constant which depends upon the system of units in use and upon the properties of the material used to make the string.

However, if it is desired to calculate the pull of a wrapped string, a modification of this formula must be used in order to allow for the effective increase in the mass of the string due to the addition of the wrapping. The effect of the wrapping is assumed to be only to add mass to the core wire. The following formula may be used to calculate the pull of a wrapped string:

$$\text{PULL} = \frac{f^2 L_s^2 d_c^2 F}{K} \quad (7)$$

Formula (7) will be seen to be the same as formula (6) except for the multiplier F, which is the loading factor due to the wrapping. If the string is to be a space-wrapped string, F may be called F' to identify it as such.

More often the designer will want to find what value the factor F or F' should have in order to produce a string having a given pull to be made with a particular size of core wire for a note have a certain frequency. In this case, formula (7) may be rearranged as shown below so that the factor F or F' may be found if all the other values are known.

$$F = \frac{(\text{Pull})\, K}{f^2 L_s^2 d_c^2} \quad (8)$$

The factor F is also useful in the design of longitudinally tuned strings, as explained in the specification of U.S. Pat. No. 3,523,480, and therefore no example will be given here of the calculation of space-wrapped strings having the longitudinal mode of vibration tuned in accordance with that invention.

An additional example will be given to further illustrate the advantages of space-wrapped strings according to the present invention. In this case, three space-wrapped strings were designed to replace three conventional plain wire strings for note 21 of a piano in which the original strings were made of plain steel wire 0.0472" (1.2 mm) in diameter and had a speaking length of 68.66 inches. The frequency of note 21 is 87.307 Hz. at the standard pitch A=440 Hz. The calculated pull for each original string was 182.9 lb., and the inharmonicity of the 30th partial was measured to be about 75 cents. These strings were replaced by three space-wrapped strings using 0.043" (approx. 1.1 mm) core wire space-wrapped with copper wrapping wire of 0.015" diameter, having F' equal to approximately 1.32. The new strings had a calculated pull of 200 lb. and a measured inharmonicity of the 30th partial of only about 31 cents. The improvement in the sound of the instrument was quite evident. If it had been possible to replace the original plain wire strings with strings having conventional close-spaced copper wrapping but the same core wire and the same pull as the spaced-wrapped strings, the wrapping wire would have been required to have a diameter of only 0.00354", a size which those skilled in the string-making art will recognize as impractical.

The present invention thus provides space-wrapped strings having uniform and reproducible characteristics, thereby making it possible to manufacture musical instruments, such as pianos, having improved tone. This is achieved through wrapped string performance which was heretofore unknown. The present invention permits the design of wrapped strings which can be used in sections of a piano scale for which it was formerly either impossible or impractical to design wrapped strings. The result is that tone quality is improved through a reduction of inharmonicity of the piano strings, through improved ability to control the tension and uniformity from note to note of the piano scale, through an improved ability to tune precisely the longitudinal mode frequency of the notes, and through a new capability to tune longitudinally the strings of notes that formerly could not be optimally tuned.

Wrapped strings in accordance with the invention, i.e., wrap strings wherein the wrapping wire defines helical convolutions which are uniformly spaced apart by a distance which is equal to the diameter of the wrapping wire, can be defined by the equation:

$$\phi = \tan^{-1}\frac{d_c + d_w}{d_w}$$

wherein $\phi$ is the angle defined by the convolutions of the wrapping wire with respect to the longitudinal axis of the core wire, $d_c$ is the diameter of the core wire and $d_w$ is the diameter of the wrapping wire. Thus, as long as the angle of the wrapping wire convolutions with respect to the core wire is equal to or less than $\phi$, the spacing of the convolutions will fall within the parameters of the invention.

Figure 7:
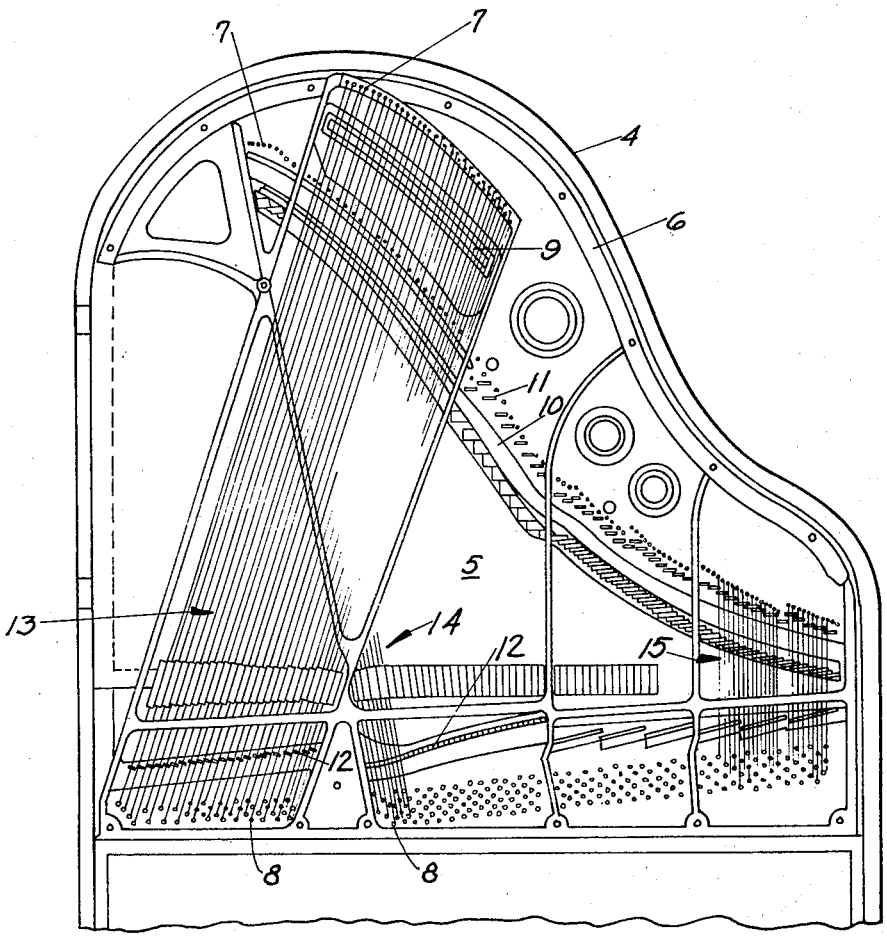
FIG. 7 is a plan view of a piano incorporating adjoining series of strings in accordance with the invention.
Figure 8:
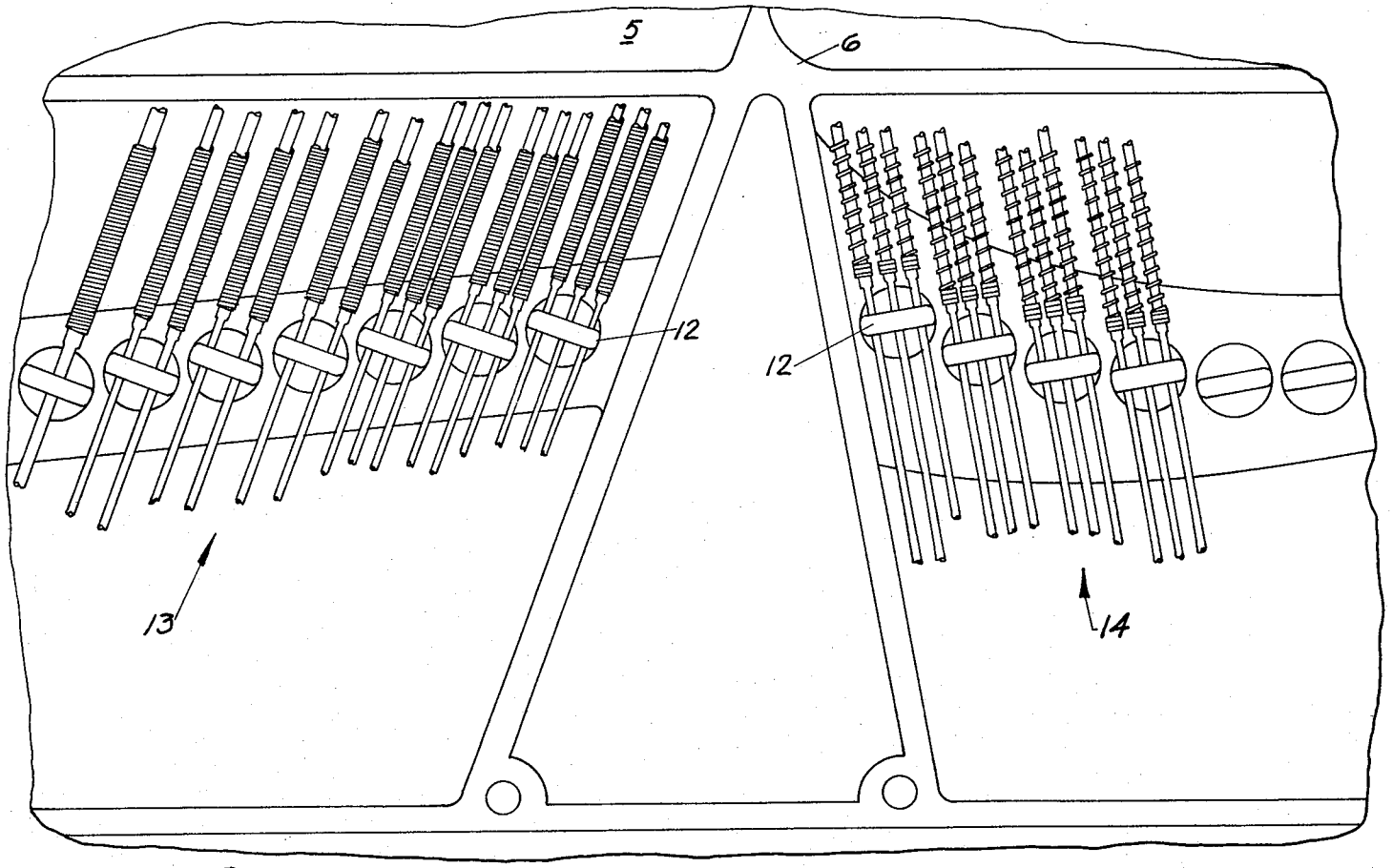
FIG. 8 is an enlarged fragmentary plan view of the adjoining series of strings.

FIGS. 7 and 8 illustrate the application of the invention to a conventional grand piano having a case 4 which mounts a soundboard 5 and a string plate 6 to which the strings are secured by means of hitch pins 7 at the rear portion of the string frame and tuning pins 8 at the forward end of the string plate, the strings passing over the bridges 9 and 10 attached to the soundboard 5. In order to prevent the portions of the strings between the bridges and the hitch pins from contacting the plate and, where it is desired to terminate the strings so as to tune them to desired frequencies, string rests 11 are placed upon or fastened to the rear portion of the string plate. Toward their forward ends the strings are engaged by agraffe means 12 which may comprise brass pieces with enlarged heads and threaded shanks engaged in holes in the string plates, although other forms of agraffe means may be employed.

The speaking length of the strings is that portion of the strings extending between the agraffe means 12 and the bridges 9 or 10. A partial series of wrapped bass strings is indicated at 13. These bass strings 13 will comprise conventional close wrapped strings, whereas in accordance with the invention the next adjacent series of strings in the musical scale, indicated at 14, will comprise wrapped strings in which the convolutions of the wrapping wire are spaced apart by a distance at least as great as the diameter of the wrapping wire. The series of strings 14 is followed by a series of plain strings, indicated at 15, extending throughout the remainder of the scale. It will be understood that each note in the scale may comprise from 1 to 3 strings depending upon its location. It will be further understood that the transition from close wrapping to spaced wrapping need not occur at the specific scale location shown in the example of FIGS. 7 and 8.

What is claimed is:

1. A wrapped piano string having a predetermined speaking length, said string comprising a core wire and a wrapping wire wound on the core wire, characterized in that said wrapping wire defines uniformly spaced apart helical convolutions terminating within and adjacent to the ends of the speaking length of the string, the helical convolutions being spaced apart by a distance at least as great as the diameter of the wrapping wire.

2. A wrapped piano string according to claim 1 wherein the diameter of said core wire is greater than the diameter of said wrapping wire.

3. A wrapped piano string according to claim 2 wherein the wrapping wire is copper and has a diameter of at least about 0.01 inches.

4. A wrapped piano string according to claim 2 wherein the wrapping wire is a copper-covered wire having a diameter of at least about 0.006 inches.

5. A wrapped piano string having a predetermined speaking length, comprising a core wire and a wrapping wire wound on said core wire to form uniformly spaced apart helical convolutions coextensive with the speaking length of the string, said helical convolutions each defining an angle with respect to the longitudinal axis of the core wire which angle is equal to or less than $\phi$ wherein:

$$\phi = \tan^{-1}\frac{d_c + d_w}{d_w}$$

and wherein $d_c$ is the diameter of the core wire and $d_w$ is the diameter of the wrapping wire.

6. A wrapped piano string according to claim 5 wherein $d_c > d_w$.

7. In combination in a piano, a first series of adjacent strings in the bass region of the piano scale, said first series of strings comprising wrapped strings each having a core wire and a wrapping wire wound on the core wire to define helical convolutions lying in side by side relation to define close wrapped strings, and a second series of adjacent strings in the region of the piano scale immediately adjacent said first series of strings, said second series of strings comprising wrapped strings each having a core wire and a wrapping wire wound on the core wire to define helical convolutions, the pitch of the convolutions being such that adjacent convolutions of each wrapping wire are spaced apart by a distance at least as great as the diameter of said second series wrapping wire.

8. The combination claimed in claim 7 wherein the helical convolutions in said first series of wrapped strings lie in contacting relation.

9. The combination claimed in claim 7 wherein the helical convolutions in said first series of wrapped strings are spaced apart by distances which are less than the diameters of the first series wrapping wires.

10. The combination claimed in claims 8 or 9 wherein the diameter of each core wire in said second series of strings is greater than the diameter of the corresponding wrapping wire in each of said second series of strings.

* * * * *